US008136667B2

(12) United States Patent
Raynor

(10) Patent No.: US 8,136,667 B2
(45) Date of Patent: Mar. 20, 2012

(54) CUP RETAINING APPARATUS AND METHODS

(76) Inventor: Eileen M. Raynor, Jacksonville, FL (US)

( * ) Notice: Subject to any disclaimer, the term of this patent is extended or adjusted under 35 U.S.C. 154(b) by 0 days.

(21) Appl. No.: 12/239,650

(22) Filed: Sep. 26, 2008

(65) Prior Publication Data

US 2010/0078350 A1 Apr. 1, 2010

(51) Int. Cl.
*B65D 1/34* (2006.01)

(52) U.S. Cl. ..... 206/563; 206/560; 206/759; 206/217

(58) Field of Classification Search ..... 206/217, 206/560, 562, 563, 565, 557, 486, 490, 426, 206/759, 541, 549; 220/574, 150.5, 556; D7/550.1, 552.1, 553.8, 507, 505; 248/346.11
See application file for complete search history.

(56) References Cited

U.S. PATENT DOCUMENTS

| | | | | |
|---|---|---|---|---|
| 1,272,996 | A | 7/1918 | Poschadel | |
| 1,595,356 | A | 8/1926 | Moseman | |
| 1,848,066 | A | 3/1932 | Shepard et al. | |
| 2,602,310 | A * | 7/1952 | Hansen | 206/426 |
| 2,703,185 | A | 3/1955 | Cook | |
| 3,401,863 | A | 9/1968 | Earl | |
| 3,633,785 | A | 1/1972 | Cyr et al. | |
| 3,675,811 | A | 7/1972 | Artz | |
| 3,708,086 | A | 1/1973 | Colato | |
| 3,955,672 | A | 5/1976 | Brundage | |
| 4,732,274 | A | 3/1988 | Bouton | |
| 4,867,331 | A | 9/1989 | Task | |
| 4,961,555 | A | 10/1990 | Egan, Jr. | |
| 4,966,297 | A | 10/1990 | Doty | |
| 5,067,271 | A * | 11/1991 | Henning | 43/60 |
| 5,119,967 | A | 6/1992 | Ercolani | |
| 5,236,119 | A | 8/1993 | Chu | |
| 5,259,528 | A | 11/1993 | Pace et al. | |
| 5,361,932 | A * | 11/1994 | Friedrich | 220/574 |

(Continued)

FOREIGN PATENT DOCUMENTS

DE 196 03 590 C1 4/1997

OTHER PUBLICATIONS

International Patent Application No. PCT/US2009/057844 filed Sep. 22, 2009 in the name of Raynor, International Search Report and Written Opinion mailed Nov. 9, 2009.

*Primary Examiner* — J. Gregory Pickett
*Assistant Examiner* — Raven Collins
(74) *Attorney, Agent, or Firm* — Levine Bagade Han LLP

(57) ABSTRACT

Cup retaining apparatus and methods are described herein. Retaining a cup or glass within or along a plate assembly allows for the user to hold both the plate and cup or glass with a single hand. Generally, a cup or glass retaining plate assembly may comprise a platform defining an opening which is sized to support a cup or glass extending at least partially through the platform. A retaining clip or arm may be pivotably attached to the platform and movable between a retaining position and a releasing position, wherein the opening opens along a portion of a periphery of the platform such that the cup or glass is secured within the opening when the retaining clip or arm is in the retaining position and wherein the cup or glass is removable when the retaining clip or arm is in the releasing position.

14 Claims, 3 Drawing Sheets

U.S. PATENT DOCUMENTS 5,662,240 A 9/1997 Norris
5,865,480 A * 2/1999 Bain et al. ..... 292/67
6,149,027 A * 11/2000 Rathjen ..... 220/574
7,000,799 B1 2/2006 Hamre
7,543,869 B2 * 6/2009 Davis et al. ..... 294/146
2004/0000497 A1 * 1/2004 Huang ..... 206/376
2004/0262480 A1 12/2004 Moyer

* cited by examiner

CUP RETAINING APPARATUS AND METHODS

FIELD OF THE INVENTION

The present invention relates to cup retaining apparatus and methods. More particularly, the present invention relates to cup or glass retaining assemblies which enables a user to hold and retain a cup or glass securely along or within a plate and to remove the cup or glass upon release of a retaining arm.

BACKGROUND OF THE INVENTION

At various social functions such as parties, picnics, spotting events, etc., where food and beverages are consumed, it is generally desirable for attendees to be able to use trays or plates which can support both food and beverages (contained in a cup or glass) and which can be handled by a single hand leaving the other hand free to consume the food or beverage.

Plates or trays which have been designed to accommodate both food and beverages have been previously implemented. One design simply designates a space atop a plate but requires that the cup be balanced upon the plate and is not securely maintained.

Other plates or trays have an opening defined along the plate or tray which accommodates a cup being inserted into the opening. The cup itself or a sleeve or portion of the plate or tray surrounding the inserted cup may then be grasped or held by the user to allow for balancing of the plate or tray along with the cup with a single hand. However, such a design may make the stacking, storage, and/or transport of multiple plates or trays difficult due to the unusual configuration for accommodating the cup. Moreover, such a design fails to accommodate a number of differently shaped cups, such as a wine glass which has a stem portion extending between a bowl portion and a foot portion (i.e., the base of the wine glass which enables the glass to stand freely).

Accordingly, there is a need for a plate or tray which can securely retain a cup or a glass of various configurations, such as wine glasses, and which can be easily stacked or stored.

BRIEF SUMMARY OF THE INVENTION

Retaining a cup or glass within or along a plate assembly may allow for the user to hold both the plate and cup or glass with a single hand to free the remaining hand for consuming the food upon the plate or for other activities. Generally, a cop or glass retaining plate assembly may comprise a platform defining an opening which is sized to support a cup or glass extending at least partially through the platform. A retaining clip or arm may be pivotably attached to the platform and movable between a retaining position and a releasing position, wherein the opening opens along a portion of a periphery of the platform such that the cup or glass is secured within the opening when the retaining clip or arm is in the retaining position and wherein the cup or glass is removable when the retaining clip or arm is in the releasing position.

In other variations, the cup or glass retaining assembly may generally comprise a plate attachment portion having a first and second member configured to secure the assembly to a plate periphery, a cup retaining portion extending from the plate attachment portion and defining an opening sized to support a cup or glass extending at least partially through the cup retaining portion, and a retaining clip or arm which is pivotably attached to the cup retaining portion and movable between a retaining position and a releasing position, wherein the cup or glass is secured within the opening when the retaining clip or arm is in the retaining position and wherein the cup or glass is removable when the retaining clip or arm is in the releasing position.

DETAILED DESCRIPTION OF THE INVENTION

Retaining a cup or glass within or along a plate assembly may allow for the user to hold both the plate and cup/glass with a single hand to free the remaining hand for consuming the food or for other activities. Generally, such a cup/glass retaining plate or tray assembly may comprise a food-bearing platform defining an opening which is sized to support the cup/glass extending at least partially through the platform. A retaining clip or arm may be pivotably attached to the platform and movable between a retaining position and a releasing position where the opening opens along a portion of a periphery of the plate or tray such that the cup/glass is secured within the opening when the retaining clip or arm is in the retaining position and wherein the cup/glass is removable when the retaining clip or arm is in the releasing position.

Figure 1:
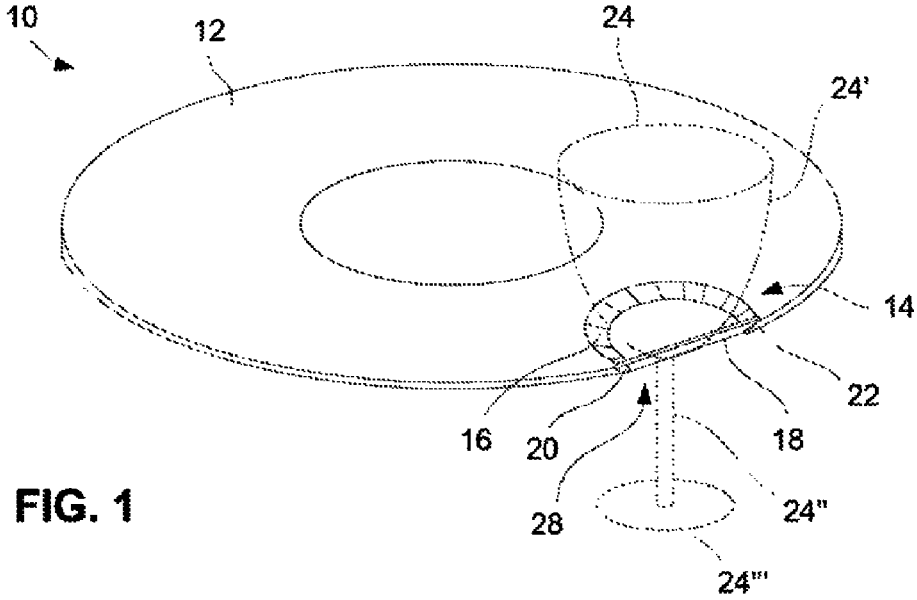
FIG. 1 shows a perspective view of a cup/glass retaining plate assembly illustrating a wine glass securely retained by the plate.

FIG. 1 shows a perspective view of one example of a cup/glass retaining plate assembly 10 comprising a plate 12 which defines a well or opening 14 through which a cup or glass may be positioned. The plate 12 may be comprised of any material typically used to form or fabricate such a plate (e.g., paper, plastic, metal, ceramic, etc.) and the plate 12 may have dimensions which are typical of such plates, although the size of the plate is not limiting and may be as large or small as practicable. Additionally, the plate assembly 10 may be fabricated to be disposable or reusable much like conventional plates. The opening 14 may be sized to have a diameter which is large enough to accommodate a cup or glass 24 extending at least partially through the opening 14 and which opens along a portion of a periphery of the plate 12. Although shown as a circular opening 14, the opening may be sized in other shapes as well, e.g., elliptical, triangular, square, rectangular, etc., so long as the shape can accommodate a cup or glass. Additionally, the circumference of the opening 14 may also be optionally chamfered 16 to further stabilize any cup or glass relative to the plate 12 when carried.

Because the supported opening 14 opens 28 along the periphery of the plate 12 and is not completely closed around its periphery, any number of cups or glasses having different shapes may be received and secured within opening 14. For instance, aside from conventional beverage containers having a uniformly tapered shape, other beverage containers such as wine glasses (as shown) having a bowl portion 24' and a stem portion 24" extending distally from the bowl 24' and terminating at a stabilizing base portion 24'", may be easily placed within supported opening 14 and secured. Such a wine glass may be supported by its bowl portion 24' around the periphery of the supported opening 14 while the stem portion 24" extends distally therefrom. Removal of such a wine glass is easily facilitated as the stem portion 24" may be simply removed via the opening 28 along the plate periphery rather than having to remove the stem 24" and base 24'" proximally through the supported opening 14.

Figure 2A:
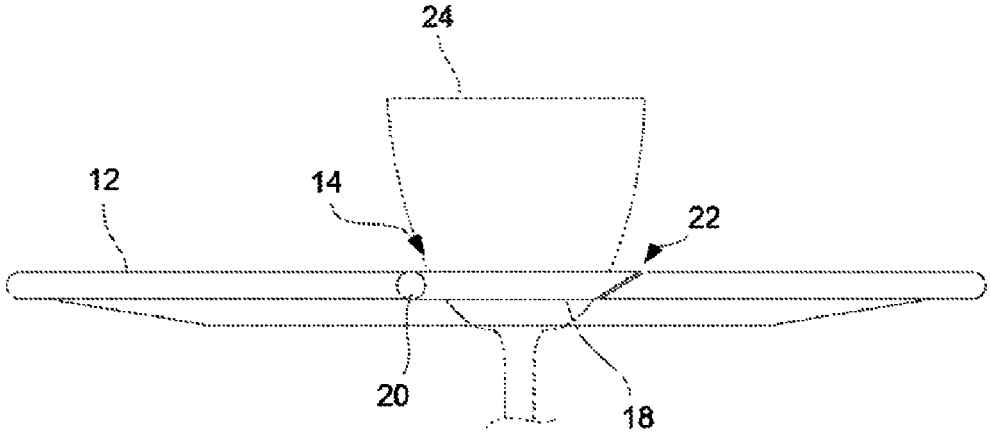
FIG. 2A shows a side view of the cup/glass retaining plate assembly with a retaining clip or arm along the periphery of the plate to secure the cup/glass.
Figure 2B:
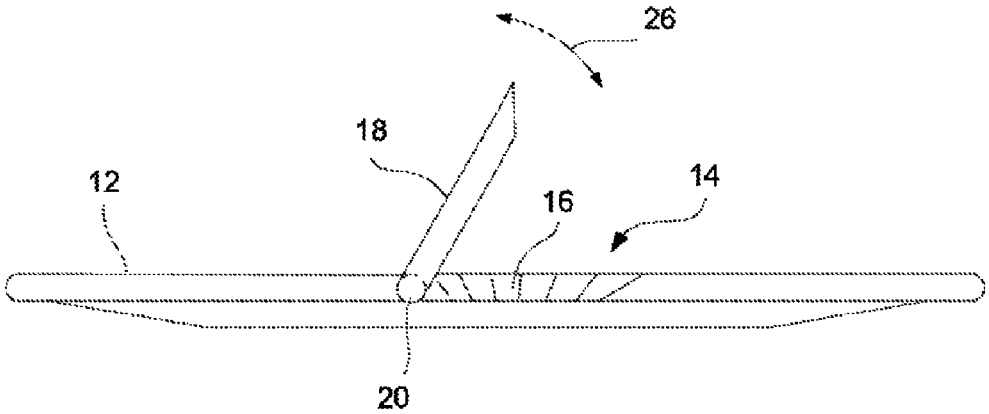
FIG. 2B shows the assembly of FIG. 2A having the retaining clip or arm pivoted at an angle to allow for the removal of the cup/glass from the plate.

When the cup or glass 24 is placed within the opening 14, a retaining clip or arm 18 (which may be fabricated from any number of materials) may be coupled or attached to a first end of the opening 28 via a pivot or hinge 20 such that the clip or arm 18 is freely rotatable about pivot or hinge 20, as shown in the side views of FIGS. 2A and 2B. Retaining clip or arm 18 may be constrained to rotate at an angle relative to a plane of the plate 12, for example, rotation of clip or arm 18 may be constrained to rotate upwardly about its pivot or hinge 20, as illustrated by the direction of rotation 26. "Upward" rotation may be considered upward relative to the plate 12 when the plate 12 is planarly situated such as when food or other items are placed upon plate 12. Having the clip or arm 18 constrained to rotate upwardly may help to ensure that when a cup or glass 24 is placed within opening 14 and resting around the periphery of opening 14 and optionally upon clip or arm 18, the clip or arm 18 is not inadvertently opened unless the cup or glass 24 is first removed from opening 14.

When the clip or arm 18 is in its retaining position, as shown in FIG. 2A, the clip or arm 18 may simply rest upon plate 12 at interface 22. Alternatively, interface 22 may optionally incorporate any locking mechanism to further inhibit the inadvertent rotation and dislodgement of clip or arm 18 from plate 12. In another alternative, clip or arm 18 may be biased, e.g., spring-loaded, to remain in its retaining position unless a force is applied to urge the clip or arm 18 into its releasing position, as shown in FIG. 2B. Moreover, when the clip or arm 18 is in its retaining position, the clip or arm 18 may form part of the periphery of the plate 12 and retain a low profile. Because of the unobtrusive profile of the clip or arm 18, stacking and/or storage of multiple plate assemblies 10 upon one another may be possible much like conventional plates.

Figure 3:
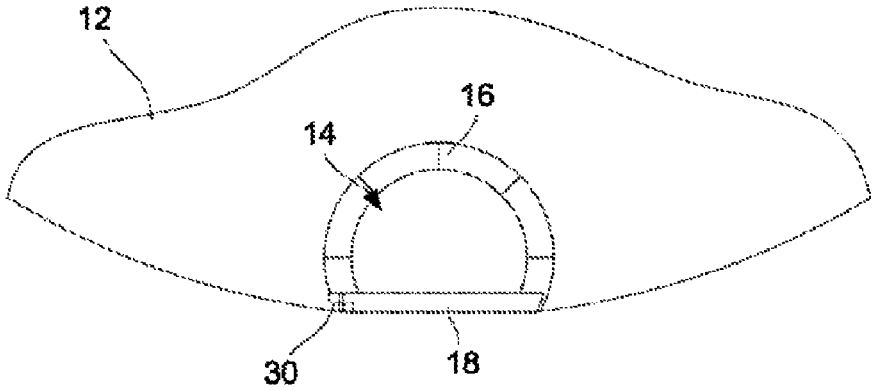
FIG. 3 shows a partial top view of a variation of the plate assembly illustrating a pinned rotatable hinge coupling the retaining clip or arm to the plate.
Figure 4:
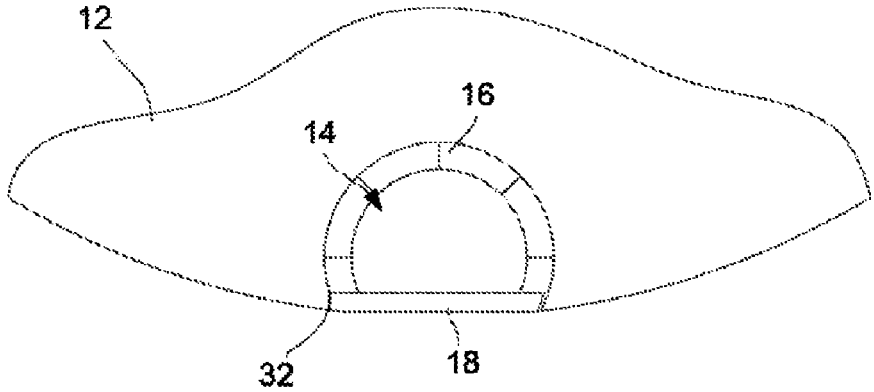
FIG. 4 shows a partial top view of another variation where the retaining clip or arm is pivotably secured to the plate via a living hinge.
Figure 5:
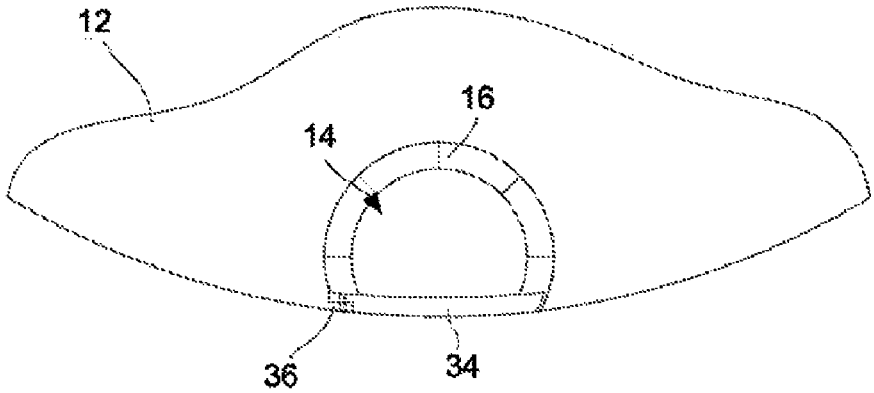
FIG. 5 shows a partial top view of yet another variation where the retaining clip or arm may be curved to approximate the radius of the plate.

As illustrated in the partial top view of FIG. 3, retaining clip or arm 18 may form a straight member which spans and obstructs the opening along the plate periphery. In this variation, clip or arm 18 may be coupled to the plate 12 via a pinned rotatable hinge 30 which may constrain the angular rotation of clip or arm 18 within a single plane. FIG. 4 illustrates another variation where clip or arm 18 may be coupled to plate 12 via a living hinge 32 where the clip or arm 18 may be fabricated from the same material or blank as plate 12. This configuration may be utilized particularly where plate 12 is fabricated from a disposable material such as paper or plastic. In yet another alternative, FIG. 5 illustrates a variation where clip or arm 34 may be curved to define a radius which is similar or uniform with a radius of the plate 12. Clip or arm 34 may be coupled to plate 12 via hinge 36 or via a living hinge or any other coupling mechanism.

Figure 6A:
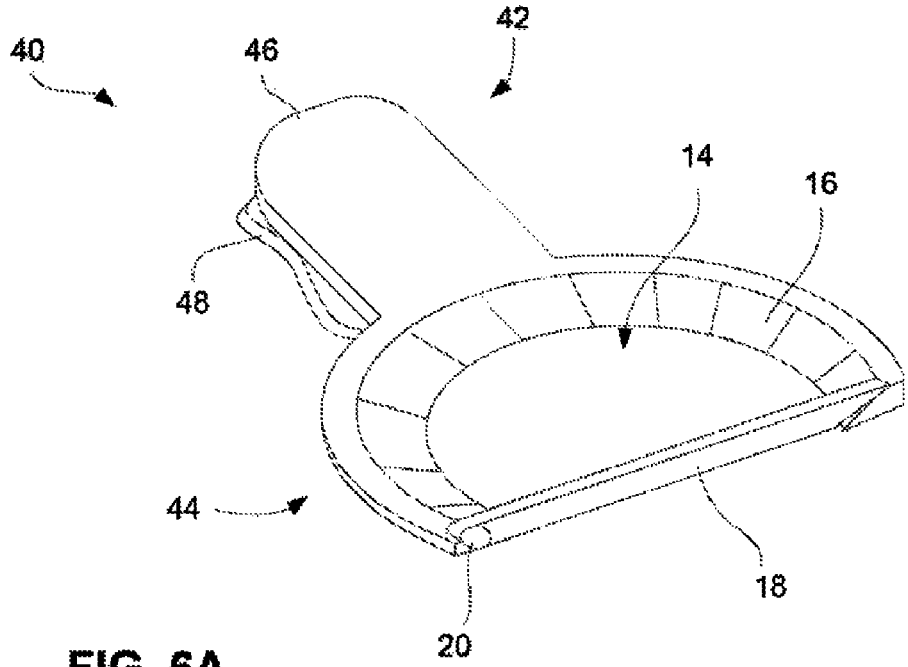
FIG. 6A shows a perspective view of yet another variation where the cup/glass retainer assembly may be configured as a detachable clip assembly.
Figure 6B:
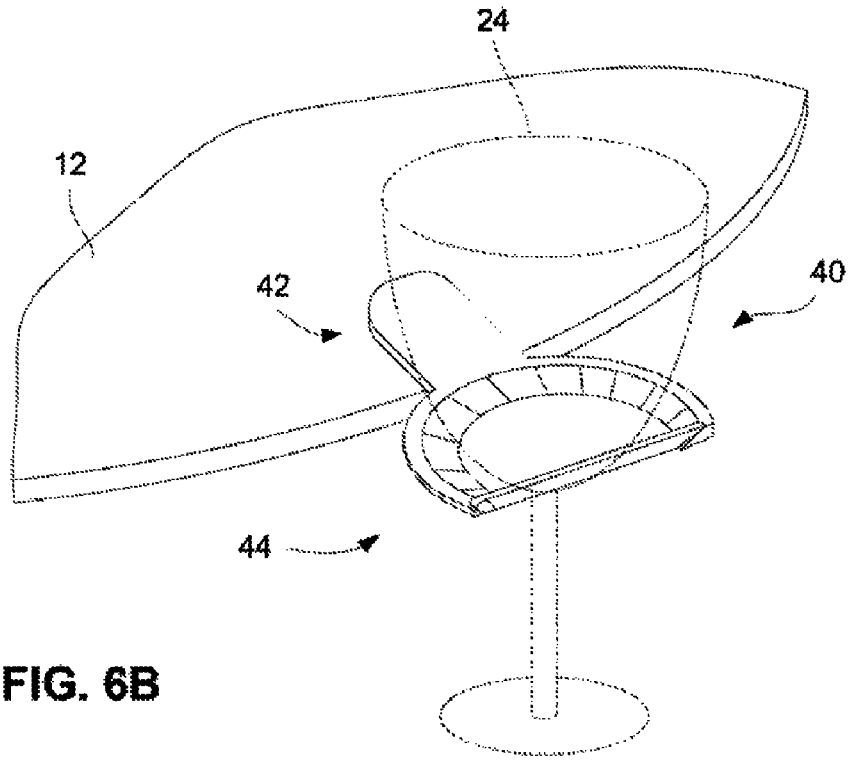
FIG. 6B shows a perspective view of the assembly of FIG. 6A attached securely to a plate and accommodating a cup/glass.

In yet another variation, FIG. 6A illustrates a detachable clip assembly 40 which may be attached to any number of plates for supporting and retaining a cup or glass in the manner described above. As shown, detachable clip assembly 40 may generally comprise a plate attachment assembly 42 having a first member 46 and a second member 48 in apposition to the first member 46 for secure attachment onto a plate. A cup retaining assembly 44 may be attached to plate attachment assembly 42 and extend planarly where opening 14 may be defined therethrough. A stabilizing chamfer 16 may also be defined around the periphery of opening 14 and retaining clip or arm 18 may be pivotably coupled via hinge or pivot 20 to move between a retaining position, as shown, and a releasing position to allow for the removal of a cup or glass. FIG. 6B shows a detail perspective view of plate attachment assembly 42 attached, permanently or temporarily, along or to a periphery of plate 12 with cup or glass 24 retained within the cup retaining assembly 44.

The applications of the disclosed invention discussed above are not limited to certain embodiments but may include any number of other variations. Modification of the above-described methods and devices for carrying out the invention and variations of aspects of the invention that are obvious to those of skill in the arts are intended to be within the scope of this disclosure. Moreover, various combinations of aspects between examples are also contemplated and are considered to be within the scope of this disclosure as well.

What is claimed is:

1. A cup/glass retaining plate assembly, comprising:

a platform defining a circular opening which is sized to support a cup/glass extending entirely through the platform;

a retaining clip or arm which is pivotably attached to the platform via a pivoting mechanism and movable between a retaining position and a releasing position, wherein the opening opens along a portion of a periphery of the platform such that the cup/glass is secured within the opening and rests upon the clip or arm when the retaining clip or arm is in the retaining position whereby the pivoting mechanism and retaining clip or arm resides along the periphery of the platform such that the opening is obstructed, and wherein the retaining clip or arm is positionable in the releasing position once the cup/glass is removed from the opening.

2. The assembly of claim 1 wherein the platform comprises a plate or tray having a food-bearing platform.

3. The assembly of claim 1 wherein the opening is sized to support a cup/glass having a stem portion.

4. The assembly of claim 1 wherein the platform is comprised of a material selected from the group consisting of paper, plastic, metal, and ceramic.

5. The assembly of claim 1 wherein the retaining clip or arm is biased to remain in the retaining position unless urged into the releasing position.

6. The assembly of claim 1 wherein the retaining clip or arm is pivotably attached to the platform via a pinned or living hinge assembly.

7. The assembly of claim 1 wherein the retaining clip or arm is pivotably attached to move at an angle relative to a plane of the platform.

8. The assembly of claim 7 wherein the retaining clip or arm is constrained to move upwardly relative to the plane of the platform.

9. The assembly of claim 1 wherein the retaining clip or arm forms a continuous portion of the periphery of the platform when in the retaining position.

10. The assembly of claim 1 wherein the plate assembly is disposable or reusable.

11. A method of retaining a cup/glass within or along a plate assembly, comprising:

providing a platform which defines a circular opening sized to support a cup/glass extending entirely through the platform; and moving a retaining clip or arm pivotably attached to the platform via a pivoting mechanism and movable between a releasing position and a retaining position such that a cup/glass extending at least partially through the platform is supported by the opening, wherein the pivoting mechanism and opening opens along a portion of a periphery of the platform such that the cup/glass is secured within the opening and rests upon the clip or arm when the retaining clip or arm is in the retaining position whereby the retaining clip or arm resides along the periphery of the platform such that the opening is obstructed and wherein the retaining clip or arm is positionable in the releasing position once the cup/glass is removed from the opening.

12. The method of claim 11 wherein the retaining clip is biased to remain in the retaining position unless urged into the releasing position.

13. The method of claim 11 wherein moving a retaining clip or arm comprises moving the clip or arm at an angle relative to a plane of the platform.

14. The method of claim 13 wherein moving comprises moving the clip or arm upwardly relative to the plane of the platform.

* * * * *